United States Patent [19]

Reid

[11] 4,138,084

[45] Feb. 6, 1979

[54] ADJUSTABLE FOUNDATION WINDOW FORM

[76] Inventor: John A. Reid, 9945 S. 1300 West, Riverton, Utah 84065

[21] Appl. No.: 813,831

[22] Filed: Jul. 8, 1977

[51] Int. Cl.[2] ..... B28B 7/30

[52] U.S. Cl. ..... 249/83; 249/39; 249/177; 249/184

[58] Field of Search ..... 249/39, 184, 177, 83

[56] References Cited

U.S. PATENT DOCUMENTS

| | | | |
|---|---|---|---|
| 1,881,971 | 10/1932 | Roedig | 249/39 |
| 2,787,820 | 4/1957 | Shields et al. | 249/39 |

FOREIGN PATENT DOCUMENTS

| | | | |
|---|---|---|---|
| 911523 | 7/1946 | France | 249/39 |
| 1134455 | 4/1957 | France | 249/39 |
| 440340 | 10/1948 | Italy | 249/39 |

*Primary Examiner*—Richard B. Lazarus
*Assistant Examiner*—John McQuade
*Attorney, Agent, or Firm*—K. S. Cornaby

[57] ABSTRACT

A reusable lightweight foundation window form is provided for use in poured concrete walls providing adjustment of the form to various thicknesses, convenient installation and removal, and a means for inserting different styles of doors, windows, and the like. Adjustment is accomplished by the use of tubular spacers of various lengths disposed between corner braces of the opening form.

8 Claims, 5 Drawing Figures

ADJUSTABLE FOUNDATION WINDOW FORM

BACKGROUND OF THE INVENTION

This invention relates to the field of formed openings in poured concrete walls.

Numerous window and door forms have been developed over the years for use in poured concrete walls, such as building foundations and the like. Such forms have been constructed of wood, pressed paper pulp, and metal to provide both repeated use and disposability. To provide adjustment to accommodate varying thicknesses of concrete walls, the forms have been made with contiguous sliding members as in the Roedig U.S. Pat. No. 1,881,971. Forms having multiple sets of various sizes to mix and match are taught in the Shields U.S. Pat. No. 2,787,820. Forms with hollowed dowels of various lengths are provided in a French Pat. No. 911,523. Prior art forms have been constructed of separate supported vertical side members, as well as full rectangular frames. Such prior art forms have been beveled on as many as three sides, so as to facilitate extraction without damage to the concrete. Despite these improvements and many others, no previous form has provided the features of the present invention.

It is an objective of the present invention to eliminate the inherent adjustment problems in prior forms by providing nonsliding self-contained adjustment while utilizing one set of forms.

Another objective is to provide a reusable and easily maneuverable form that is relatively inexpensive to construct and which allows the builder a style option.

A further objective of the present invention is to maximize light inflow through a window installed in an opening formed by the invention.

SUMMARY OF THE INVENTION

The adjustable form of the invention has a pair of mating halves and a wooden nailer. One mating half, the female member, is constructed to receive the other mating half or male member. Both mating halves are substantially rectangular and are comprised of four form sides, a reinforcing pipe, and a plurality of side braces, corner braces, and affixed adjustment spacers. All four sides are beveled to permit easy extraction from the set concrete and to provide maximum light inflow. Each of the form sides has inwardly extending flanges with a plurality of holes drilled therein. These flanges provide reinforcing strength to the sides and a means by which the form may be attached to the concrete wall form and a wooden nailer. Said reinforcing pipe runs transversely of the longitudinal sides, thereby providing reinforcement and ease of handling. The side braces provide support for the form sides and flanges. The corner braces are preferrably constructed of metal, such as angle iron, and provide squaring reinforcement, as well as a means by which said mating halves are firmly attached to each other.

Adjustment spacers are attached to the corner braces by a chain or the like. By securing a bolt through the spacer and corner braces, the mating halves are fastened together. Adjustment of the form thickness is accomplished by using spacers of different lengths or no spacer at all.

In preparation for pouring a concrete wall with a window or door opening, a wooden nailer which substantially rectangular in shape, is attached by use of screws or nails to either mating half, preferably to the inner flange of the female mating half. The wooden nailer with the female mating half is nailed to the wooden form for the concrete wall in the desired position of the opening. The male mating half is inserted into the female member and the spacers are fastened between the corner braces such that the form is of the desired thickness. The other concrete wall form is placed snuggly against the male mating half and the concrete can then be poured.

Once the concrete is set, the wall forms may be removed. By detaching the wooden nailer from the female mating half, the form of the invention can be disengaged and removed from the set concrete. The wooden nailer is left partially imbedded in the concrete to provide a means of attaching the desired style of door, window, or the like.

The adjustable opening form can then be equipped with another wooden nailer and is ready for use again.

THE DRAWINGS

A preferred embodiment of the invention is illustrated in the accompanying drawings in which:

FIG. 1 is a perspective view of the form for a door in place in a concrete wall form;

FIG. 2, an exploded perspective view of a form showing the male and female mating halves and a detached wooden nailer;

FIG. 3, a vertical elevational section of a window form set in concrete with wall forms in place;

FIG. 4, an elevation of a spacer showing its bolt bores; and

FIG. 5, a plan view of the spacer shown in FIG. 4.

DETAILED DESCRIPTION OF THE ILLUSTRATED EMBODIMENT

Figure 1:
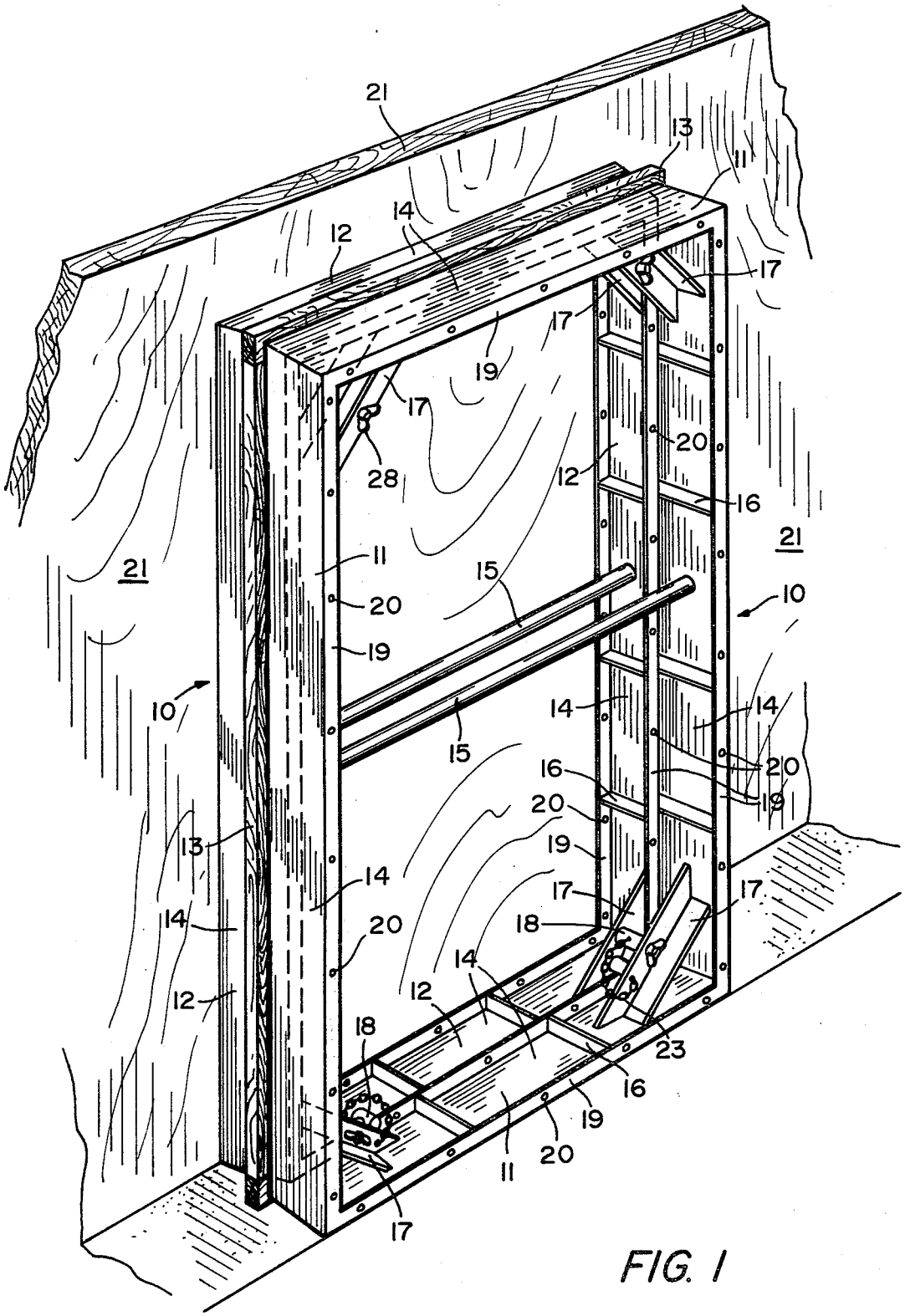
Figure 2:
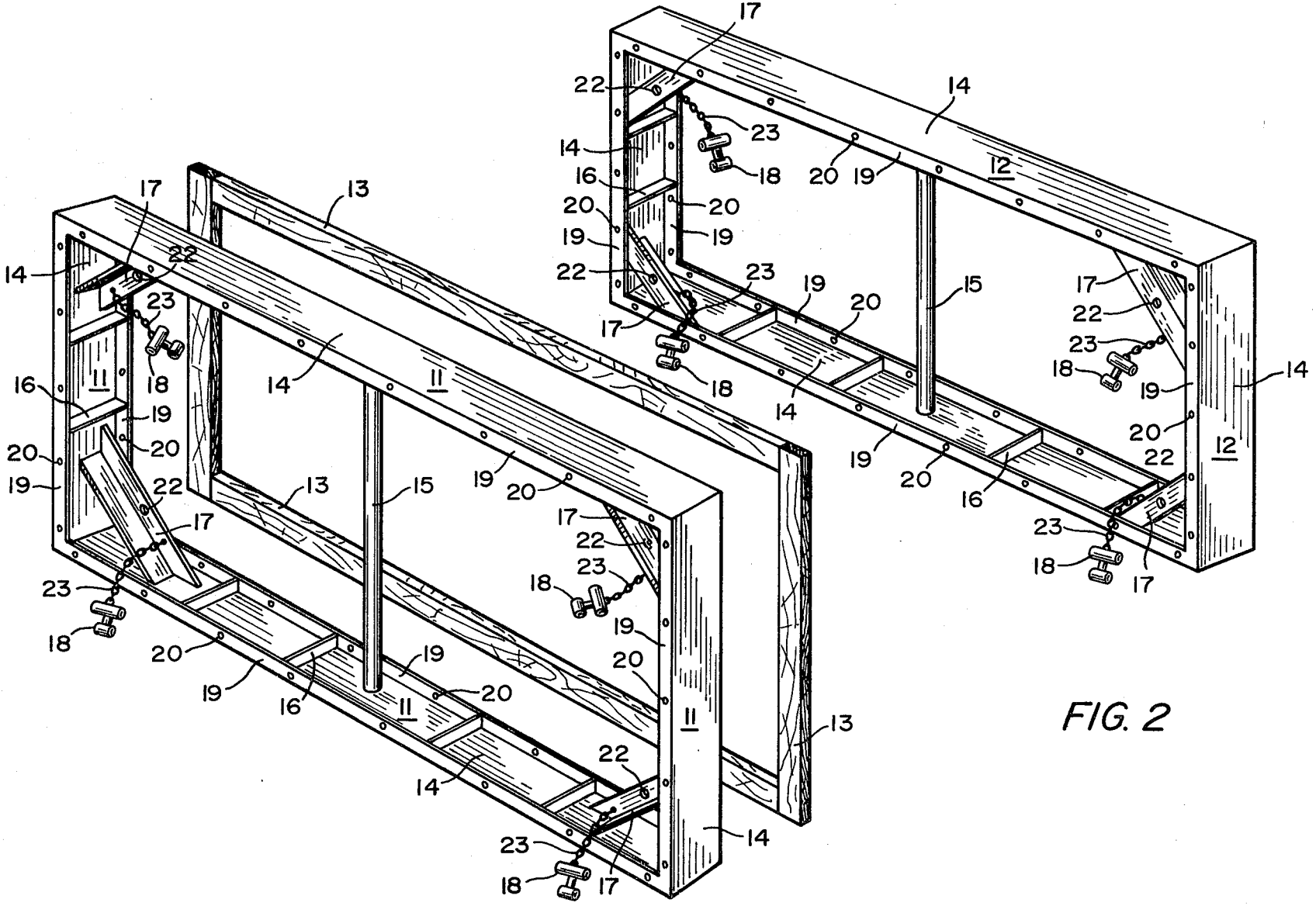
Figure 3:
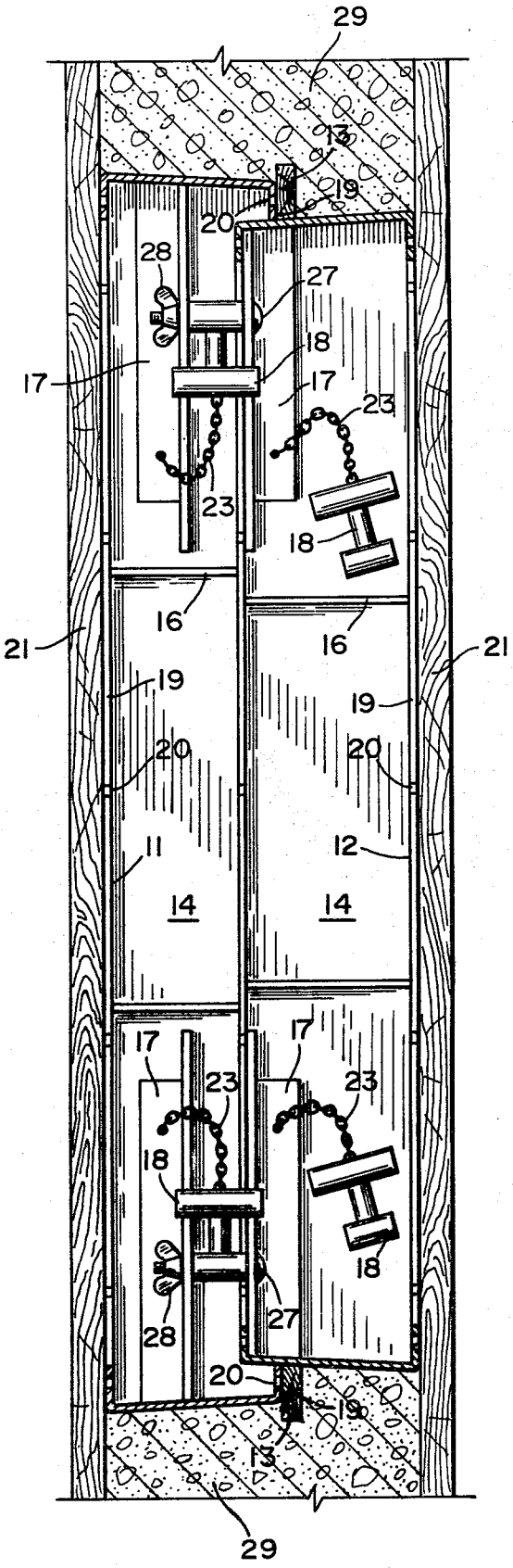

As shown in FIGS. 1–3, a preferred embodiment of the form 10 has substantially rectangular mating halves 11 and 12 and a wooden nailer 13. Female mating half 11 is constructed to receive male mating half 12 and to be attached to wooden nailer 13. Each mating half 11, 12 comprises four form sides 14, a reinforcing pipe 15, and a plurality of side braces 16, corner braces 17, and adjustment spacers 18. All four sides 14 are beveled to permit easy extraction from concrete which has hardened. Such beveling also permits more light to pass through a window than in the absence of a beveled lintel.

Sides 14 have inwardly extending flanges 19 with a plurality of holes 20 drilled therein. Flanges 19 provide reinforcing strength to sides 14 and a means by which form halves 11, 12 can be attached to wooden nailer 13 and, hence to a concrete wall form 21. Reinforcing pipe 15 is welded to sides 14, such that it runs transverse to longitudinal sides 14. Pipe 15 provides strength and aides in the handling of form 10. Side braces 16 provide transverse support to form sides 14 and flanges 19. Corner braces 17 are constructed of angle metal and provide squaring reinforcement. An aperture 22 is drilled in the corner brace 17 to provide a means by which said mating halves 11 and 12 are firmly attached to each other. Adjustment spacers 18 are affixed to corner braces 17 by a chain 23 or the like.

Figure 5:
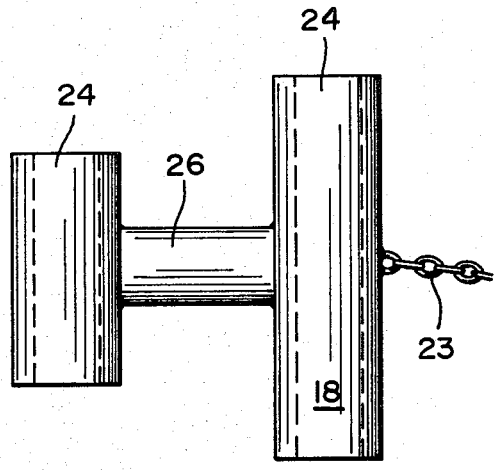
Figure 4:
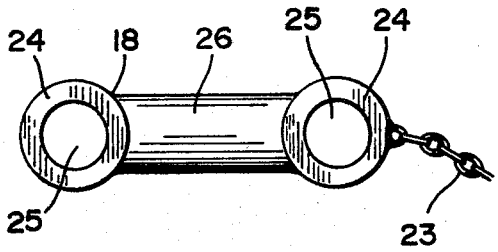

Spacers 18 comprise a pair of tubes 24 with uniform bore 25 each having a different length and joined together through a connecting member 26, as shown in FIGS. 4 and 5. Spacers 18 of each mating half 11, 12 have a pair of uniform length sets, such that when the mating halves 11 and 12 are joined four different spacer dimensions can be employed.

As illustrated in FIG. 3, by inserting a bolt 27 through corner brace aperture 22 and a desired spacer tube 24, and securing the bolt with a nut 28, mating halves 11, 12 can be fastened together. Adjustment of the width of form 10 is accomplished by using any combination of the four spacer sets or no spacer at all to provide five different form widths, including 6, 8, and 10 inch widths.

Mating halves 11, 12 and components thereof are preferably constructed of aluminum or stainless steel; however, any material having the requisite strength under repeated use can be used.

As shown in FIG. 3, application of form 10 requires that wooden nailer 13 be attached by use of screws or nails to inner flange 19 of female half 11. The female half is nailed to a wall form 21 in the desired position. Male half 12 is then inserted into female member 11. It is understood that male member 12 may be nailed to wall form 21 first, and then female member 11 disposed thereover. Spacer tubes 24 of uniform length are fastened between corner braces 17 such that form 10 is of the desired width. The remaining wall form 21 is snugly positioned against male half 12. Concrete 29 can then be poured about the form 10, as shown in FIG. 3.

When concrete 29 is set, wall forms 21 can be removed. By extracting the screws or nails securing wooden nailer 13 to female mating half 11, the form 10 may be disengaged and easily removed from formed concrete 29. Wooden nailer 13 is left partially imbedded in concrete 29 providing a means by which the builder may insert any style of door or window in the opening formed in the concrete wall.

It is understood that the particular form of the invention described herein and illustrated in the accompanying drawing is a preferred embodiment. Various changes in shape, size, materials, and arrangement of parts may be made without departing from the spirit of the invention as defined in the attached claims.

I claim:

1. An adjustable form for creating openings such as windows in poured concrete walls, comprising in combination:

a rectangular form comprising a pair of cooperating rectangular mating members one insertable into the other, said members having corresponding mutually facing edges which are tapered permitting easy removal when the concrete is set;

a wooden nailing frame attachable to either of said mating members;

an adjustment mechanism comprising corner braces attached to the corners of said mating members and adjustment spacers for placement between corresponding braces of both members and fastened into place by fastening means; and attachment means comprising a flange extending inwardly from each side of said mating members with apertures therein for accepting nails to attach said mating members to forms into which concrete is poured to form concrete walls.

2. An adjustable form as set forth in claim 1, wherein said wooden nailing frame is adapted to remain partially imbedded in said concrete wall thereby providing a means of attachment for entrance frames.

3. An adjustable form as set forth in claim 1, wherein said mating members have side braces and a reinforcing member to provide strength and convenient handling of said adjustable form.

4. An adjustable form as set forth in claim 1, wherein said adjustment spacers are constructed of a pair of tubes of different lengths to provide predetermined thickness adjustment of said adjustable form.

5. An adjustable form as set forth in claim 1, wherein said adjustment spacers are attached to said mating members with a flexible chain.

6. An adjustable form as set forth in claim 1, wherein said adjustment spacers are attached to only one of the mating members.

7. An adjustable form as set forth in claim 4, wherein said tubes of said spacers are constructed to provide form widths of 6 inches, 8 inches, and 10 inches.

8. An adjustable form as set forth in claim 1, wherein said mating members and said spacers are constructed of aluminum.

* * * * *